US006176563B1

(12) United States Patent
Anderson et al.

(10) Patent No.: US 6,176,563 B1
(45) Date of Patent: Jan. 23, 2001

(54) INK MARKING DEVICE MAINTENANCE FLUID REPLENISHMENT SYSTEM AND METHOD

(75) Inventors: David G. Anderson, Ontario; Frederick A. Donahue, Walworth; Leonard M. Carreira; Arthur M. Gooray, both of Penfield, all of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/232,457

(22) Filed: Jan. 19, 1999

(51) Int. Cl.[7] ..... B41J 2/165
(52) U.S. Cl. ..... 347/22
(58) Field of Search ..... 347/22, 28, 33

(56) References Cited

U.S. PATENT DOCUMENTS 5,068,681 * 11/1991 Kosugi et al. ..... 396/572
5,534,897 7/1996 Anderson et al. .
5,751,327 * 5/1998 De Cock et al. ..... 347/130
5,757,398 5/1998 Anderson .
5,790,146 * 8/1998 Anderson ..... 347/28
5,793,390 8/1998 Claflin et al. .
5,832,341 * 11/1998 Facci et al. ..... 399/97

* cited by examiner

*Primary Examiner*—N. Le
*Assistant Examiner*—Judy Nguyen
(74) *Attorney, Agent, or Firm*—Oliff & Berridge, PLC

(57) ABSTRACT

A method of replenishing fluid used in an marking device maintenance station of an ink marking device includes obtaining condensate from ambient air through a condensation process and channeling the condensate to a reservoir in communication with the marking device maintenance station.

18 Claims, 7 Drawing Sheets

INK MARKING DEVICE MAINTENANCE FLUID REPLENISHMENT SYSTEM AND METHOD

BACKGROUND OF THE INVENTION

1. Field of Invention

This invention relates to ink marking devices, and more particularly to a system and method by which maintenance fluid used by a maintenance station in maintaining a printhead of the ink marking device is replenished.

2. Description of Related Art

Maintaining optimum performance in an ink marking device requires maintenance, particularly of the printhead that expels the ink to mark the media as desired by the user.

Liquid ink printers of the type frequently referred to as continuous stream or as drop-on-demand, such as piezoelectric, acoustic, phase change wax-based or thermal, have at least one printhead from which droplets of ink are directed towards a medium, e.g., a recording sheet. Within the printhead, the ink is contained in multiple channels. Power pulses cause the droplets of ink to be expelled as required from the orifices or nozzles at the end of the channels.

In a thermal ink jet marking device or printer, the power pulses are usually provided by resistors positioned in respective channels that are individually addressable to heat and vaporize ink in the channels. As voltage is applied across a selected resistor, a vapor bubble grows in the associated channel and initially bulges from the channel orifice before collapsing. The ink within the channel then retracts and separates from the bulging ink, forming a droplet moving in a direction away from the channel nozzle and toward the medium. Upon hitting the medium, the droplet forms a dot or spot of ink. The channel is then refilled by capillary action, which draws ink from an ink supply container.

The ink jet printhead may be incorporated into either a carriage type printer (i.e., a partial-width array type printer) or a page-width array type printer. The carriage type printer typically has a relatively small printhead containing the ink channels and nozzles. The printhead can be attached to a disposable ink supply cartridge. The printhead and attached ink supply carriage are reciprocated together on the carriage to print one swath of information (equal to the length of a column of the nozzles) at a time on a stationary medium. After the swath is printed, the paper is stepped forward a distance equal to the height of the printed swath or a portion thereof, so that the next printed swath is contiguous or overlapping with the previously printed swath.

In contrast, the page-width array printer has a stationary printhead having a length sufficient to print across the width or length of a recording sheet. The recording medium is continually moved past the page-width array printhead in a direction substantially normal to the printhead length and at a constant or varying speed during printing.

It has been recognized that the ink ejecting nozzles of the printhead must be maintained, e.g., by periodically cleaning the orifices when the printhead is in use, and/or by capping the printhead when the printer is not in use or is idle for extended periods of time. The capping of the printhead prevents the ink in the printhead from drying out and potentially clogging the nozzles. In particular, a "viscous plug" of partially dried ink in the nozzle can cause the ejector to fail, at least temporarily, until the particular ejector is reheated and the viscous plug is softened and expelled. Ink droplets from a partially blocked ejector can be misdirected.

The failure of even one nozzle will have conspicuous results on a printed swath, because the plugged nozzle will leave a blank stripe where ink should have been deposited. In some applications, there is also a need to prime a printhead before use to insure that the printhead channels are completely filled with ink and contain no contaminants or air bubbles.

With any kind of ink jet marking device in which a printhead is in close and extended contact with a medium, such as a sheet of paper marked with partially-dried ink, an important practical concern is contamination of the area around the ejectors. External debris such as lint or stray paper fibers are likely to become caught in the small gap between the front face of the printhead and the sheet, possibly entering the nozzles of the ejectors and causing a failure.

Conventional maintenance stations perform two primary functions. In a first function, the printhead nozzles are maintained by wiping clean the nozzle face of the printhead to remove any contaminants or ink which may have collected on the nozzle face. In some applications, vacuum is also applied to assist in removing of the ink and contaminants. In the second function, the printhead is capped to prevent the printhead nozzles from being exposed to air for extended periods of time.

Regarding the first function, wiping using wet wiper nozzles is known. As disclosed in, e.g., U.S. Pat. No. 5,790,146 to Anderson, which is commonly assigned and is incorporated herein by reference, wet wiper nozzles apply a small amount of maintenance fluid to the nozzle face. The wet wiper nozzles remain spaced from the nozzle face, but a thin film of maintenance fluid is applied on the nozzle face through the formation of a meniscus. The maintenance fluid is substantially comprised of water, but may include small amounts of dissolved detergents. Examples of other conventional maintenance systems and components thereof are disclosed in commonly assigned U.S. Pat. Nos. 5,534,897, 5,757,398 and 5,793,390, which are incorporated herein by reference.

In the case of partial-width array marking devices, the wiper nozzles are generally stationary, and the motion of the printhead moving past the wiper devices completes the wiping operation. With a full-width array printhead, the wiping devices are moved past the stationary printhead.

When wet wiper nozzles are used, the maintenance fluid is consumed. As a result, this maintenance fluid must be replenished over time. Depending upon the particular configuration of the marking device, refilling and/or replenishing the reservoir for the maintenance station can be difficult, and/or lead to problems with other systems in the marking device. Therefore, it would be desirable to provide a system and method by which the maintenance fluid could be replenished. In addition it would be desirable if the maintenance fluid could be replenished through use of by-products from the normal operation of the ink marking device to reduce costs and waste.

SUMMARY OF THE INVENTION

The present invention provides a system and method by which maintenance fluid for an ink marking device maintenance station is replenished during normal operation of the ink marking device.

According to a method of the invention, fluid used in the ink marking device maintenance station is replenished by obtaining condensate from ambient air through a condensation process and channeling the condensate to a reservoir in communication with the marking device maintenance station.

Preferably, the ink marking device marks media with ink and includes a dryer, and the method includes drying the media marked with ink with the dryer, thereby producing a dryer effluent. Obtaining the condensate preferably includes condensing the dryer effluent from the dryer. Preferably, the dryer effluent is dried in the condensation process and channeled back to the dryer for use in the drying of the media.

Preferably, the method includes performing a heat transfer process from the ambient air to a condensing element, which is at a lower temperature than the ambient air.

Preferably, the condensing element is a cooling coil through which cooling fluid flows, and the condensation process includes passing the ambient air over the cooling coil such that heat is transferred from the ambient air to the cooling coil and fluid.

Preferably, the condensing element is a peltier device, which has a hot side and a cold side, and the condensation process includes passing ambient air over the cold side of the peltier device such that heat is transferred from the ambient air to the peltier device.

Preferably, the condensation process includes circulating the cooling fluid from a heat exchanger that cools the printhead through the cooling coil before returning the cooling fluid to the printhead. Preferably, channeling the condensate includes adding the condensate to a supply of maintenance station fluid present in the reservoir.

Preferably, the condensing element is a condenser of a refrigeration system.

BRIEF DESCRIPTION OF THE DRAWINGS

Preferred embodiments of the invention will be described with reference to the following drawings, wherein like reference numerals refer to like elements, and wherein.

DETAILED DESCRIPTION OF PREFERRED EMBODIMENTS

According to the invention, maintenance fluid in a marking device maintenance station is replenished by condensing air and channeling the condensate to a reservoir for the maintenance station. In ink marking devices equipped with a dryer, the dryer effluent (i.e., the outflow from the dryer as the drying process is conducted) may be used as a source of air for the condensation process. The dryer effluent is moisture laden from drying aqueous-based inks. As a result, the maintenance fluid consumed in a wet wiping maintenance process is replenished without requiring refilling or replacement operations by the consumer.

Figure 1:
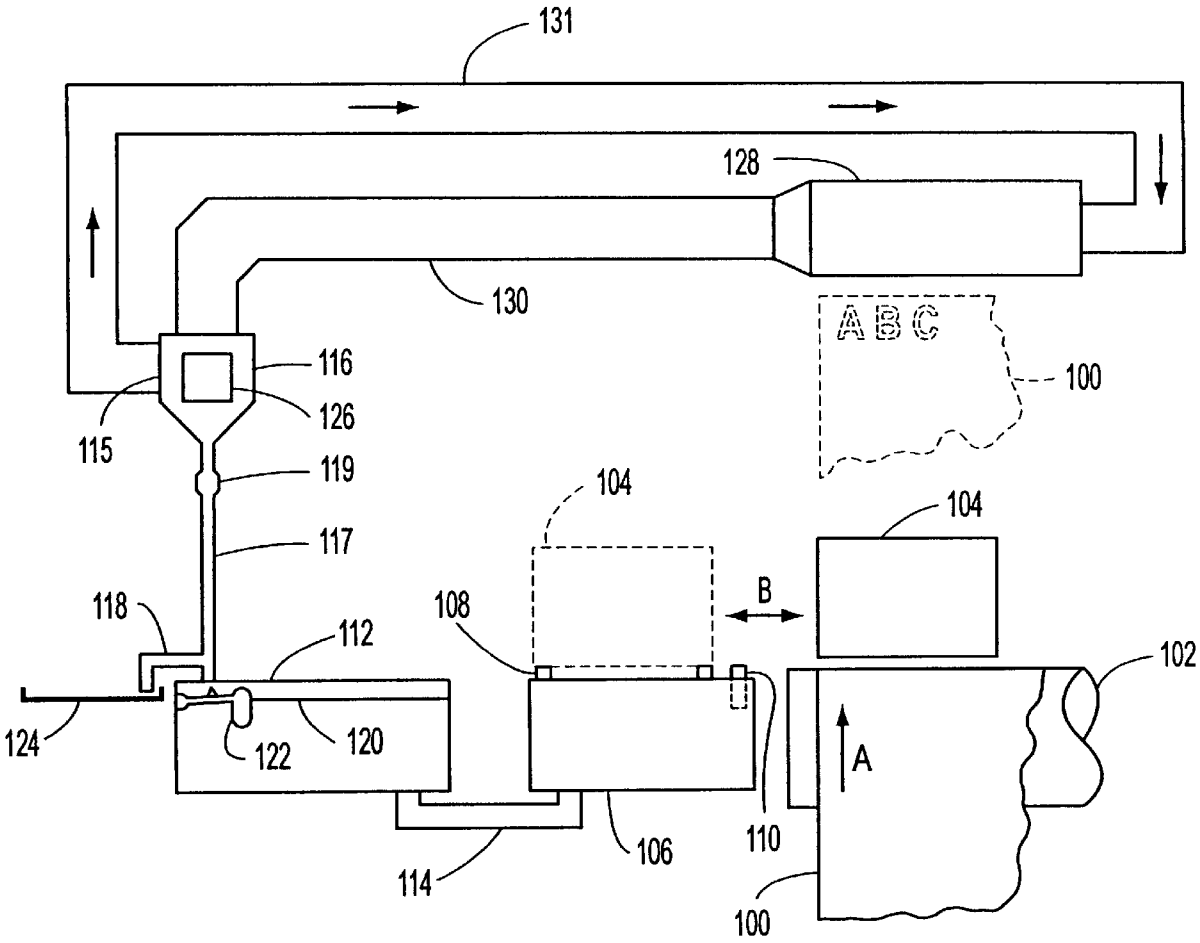
FIG. 1 is a schematic block diagram of a partial-width array printhead and a maintenance station connected to a reservoir and to a condensation chamber according to the invention.

FIG. 1 shows a schematic view of the invention configured for a partial-width printhead marking device embodiment. A recording medium 100, e.g., a recording sheet of paper or transparency material, advances in a direction A under the action of a printwheel 102. As the medium 100 is stepped forward in the direction A, a printhead 104 marks desired areas of the medium within a swath as the printhead moves across the medium 100 in the direction B. When the marking operation is concluded, or at other desirable times (e.g., when the printhead 104 will be idle for extended periods), the marking device is controlled to move from its operating position (shown in solid lines) to a maintenance position (shown in dashed lines). As the printhead 104 moves to the maintenance position, a nozzle face of the printhead 104 passes one or more wiper elements 110 before coming to rest in the maintenance position.

The wiper elements 110 draw fluid from a reservoir 112 over a connecting line 114 and supply it to the nozzle face of the printhead 104 in a controlled layer through the formation of a meniscus. Further details of the structure and operation of the wiper elements 110 are disclosed in, e.g., the incorporated U.S. Pat. No. 5,790,146. As the wet wiper elements 110 consume maintenance fluid, the fluid level 120 in the maintenance fluid reservoir 112 drops.

According to the invention, a condenser element 126 is positioned in a condensation chamber 116 for providing condensate to replenish the maintenance fluid reservoir 112 through a condensate drain tube 117. The condensing element 126 condenses ambient air from the marking device surroundings. The condensate obtained from the air, which is substantially water, replenishes the maintenance fluid. After the condensation occurs, the drier ambient air exits the condensation chamber through an air exhaust outlet 115.

The condensate may be filtered to remove contaminants (e.g., dirt, dust, etc.) before it is supplied to the maintenance fluid reservoir 112. In one embodiment, the condensate drain tube 117 includes a filter 119 positioned downstream of the condensation chamber 116.

In a preferred embodiment, the condensate chamber 116 is connected to a dryer 128 by a dryer effluent duct 130. As shown in FIG. 1, the dryer 128 is positioned within the media path downstream of the printhead to assist in drying freshly marked swaths of the medium 100 (shown in dashed lines) as it is stepped forward in the marking process. The dryer 128 dries the ink, at least partially, and in the process creates moisture laden air from the moisture driven out of the ink and the medium 100. The dryer 128 is used in applications where the operating speed of the marking device requires a previously marked sheet to be dried to prevent smearing by contact with a subsequently marked sheet (which may occur at operating speeds of 5 pages/minute or more).

The dryer 128 can be connected to an optional return duct 131 that conveys air from the air exhaust outlet 115 in the condensate chamber 116 (which is drier due to the condensation process) back to the dryer 128. Dryer efficiency is thereby improved, particularly with convective dryers, because of increased mass transfer efficiency. This configuration is also advantageous because the exhaust air from the condensate chamber is conveyed to the dryer 128, rather than being released to the immediate surroundings (e.g., an office environment).

As condensate is obtained and channeled to the maintenance fluid reservoir 112, the fluid level 120 rises. When the fluid rises beyond a desired level, excess fluid overflows through an overflow pipe 118. The overflow pipe 118 may be used in conjunction with a float valve 122 that stops flow through the condensate drain pipe 117 when the desired level 120 in the maintenance fluid reservoir 112 is reached, thus causing excess fluid to overflow through the overflow pipe 118.

Fluid that overflows through the overflow pipe 118 can be collected in an evaporation pan 124 positioned beneath the overflow pipe 118. The evaporation pan 124 preferably has a large surface area and a slight depth, thereby allowing fluid in the pan to evaporate into the surrounding air readily.

Figure 2:
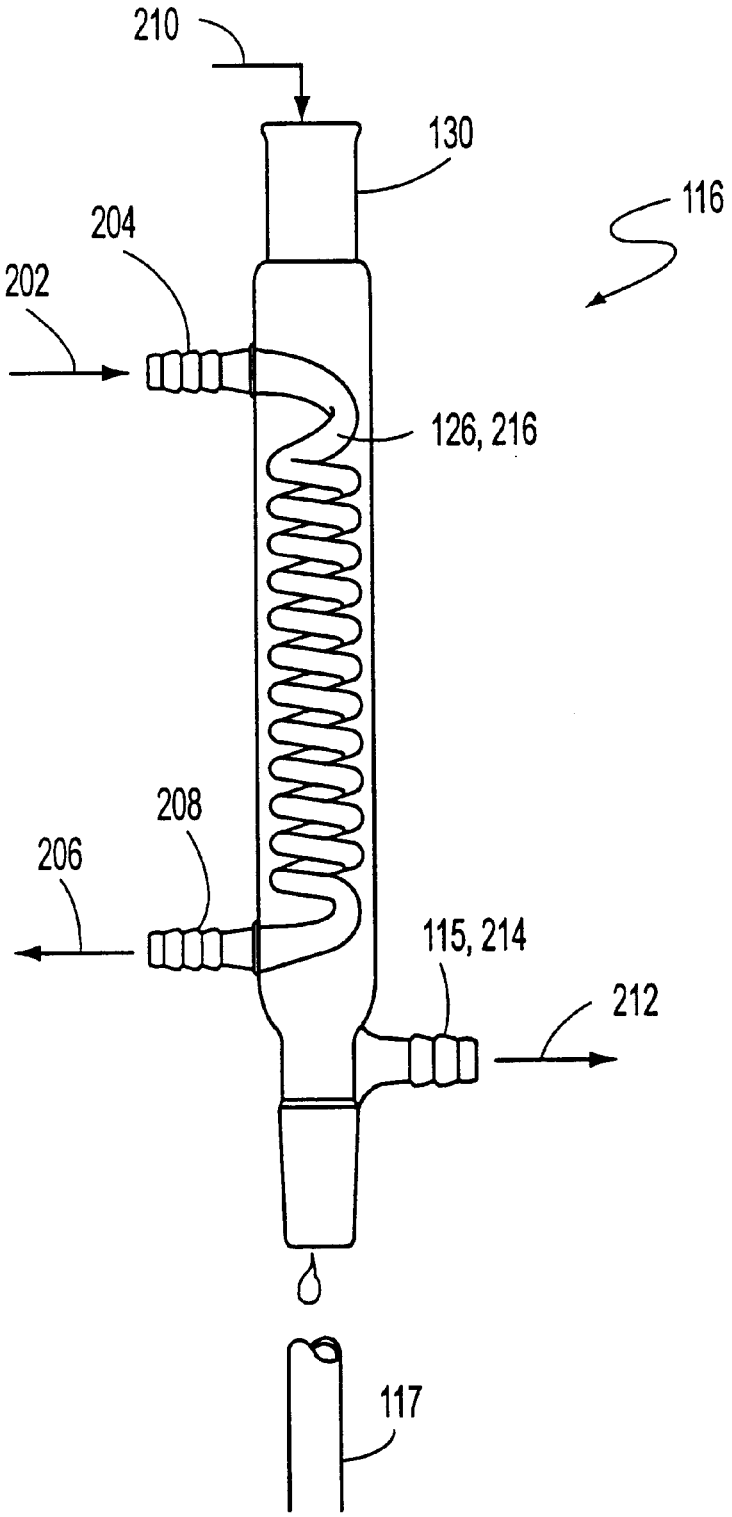
FIG. 2 is a schematic view showing a cooling coil embodiment of the condensing element.

FIG. 2 is a schematic diagram of one type of condensation element 126. In FIG. 2, a cooling coil 216 serves as the condensation element 126. A cooling fluid inflow 202 enters the cooling coil 216 through a cooling fluid inlet 204, travels through the turns in the coil and exits as a cooling fluid outflow 206 through a cooling fluid outlet 208. At the same time, a dryer effluent 210 enters the condensation chamber 130. The dryer effluent 210 moves past the cooling coil 216 towards the air exhaust outlet 115, which is preferably a dryer effluent exhaust outlet 214. As this movement takes place, the warm, moist dryer effluent 210 condenses upon the surface of the cooling coil 216, which is cooler than the dryer effluent because of the cooler temperature of the cooling fluid flowing in the cooling coil 216. Condensation occurs on the surface of the cooling coil and, eventually, drops are formed that fall downward and into the condensation drain pipe 117 for filtration (to remove, e.g., dust from dryer, etc.) and collection. A dryer effluent exhaust, which is cooler and dryer than the dryer effluent, exits through the dryer effluent exhaust outlet 214.

Figure 3:
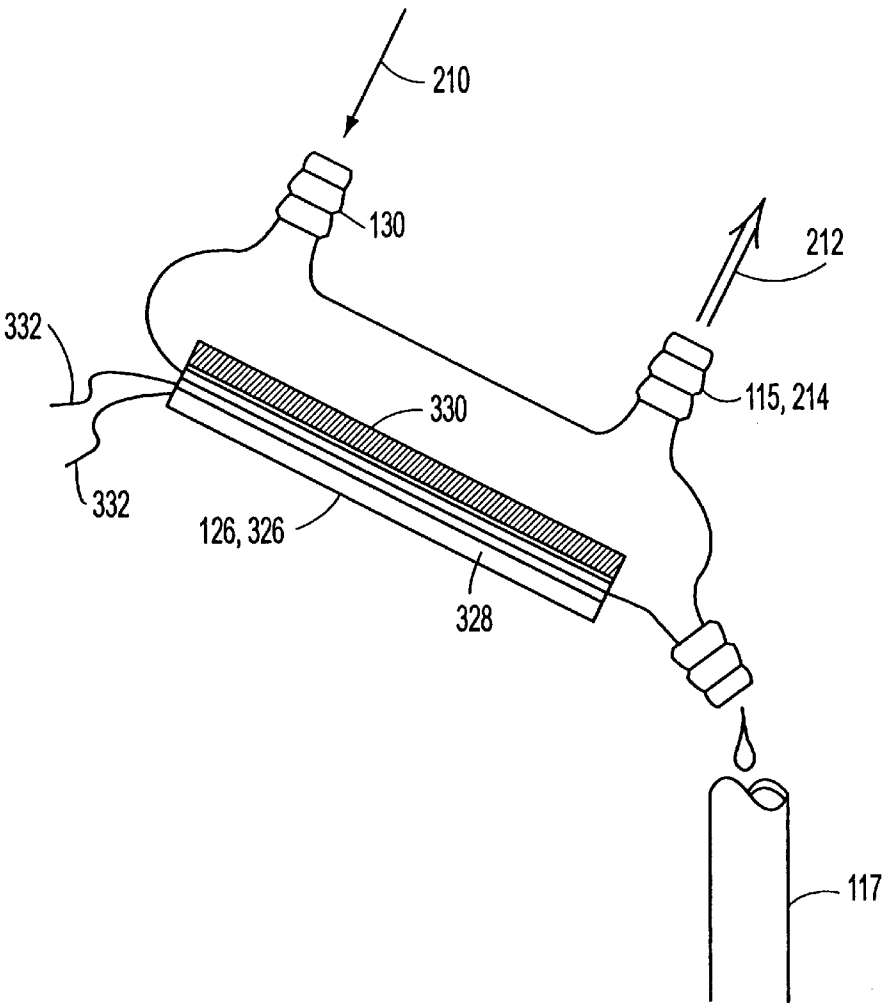
FIG. 3 is a schematic view showing a peltier device embodiment of the condenser element.

As shown in FIG. 3, the condensing element 126 in another embodiment is a peltier device 326. The peltier device is comprised of dissimilar materials, and when supplied with power through leads 332, develops a hot side 328 and a cold side 330. Similar to the cooling coil embodiment, when the dryer effluent 210 encounters the cool side 330 of the peltier device 326, condensation is formed and collected through the condensate drain pipe 117.

Figure 7:
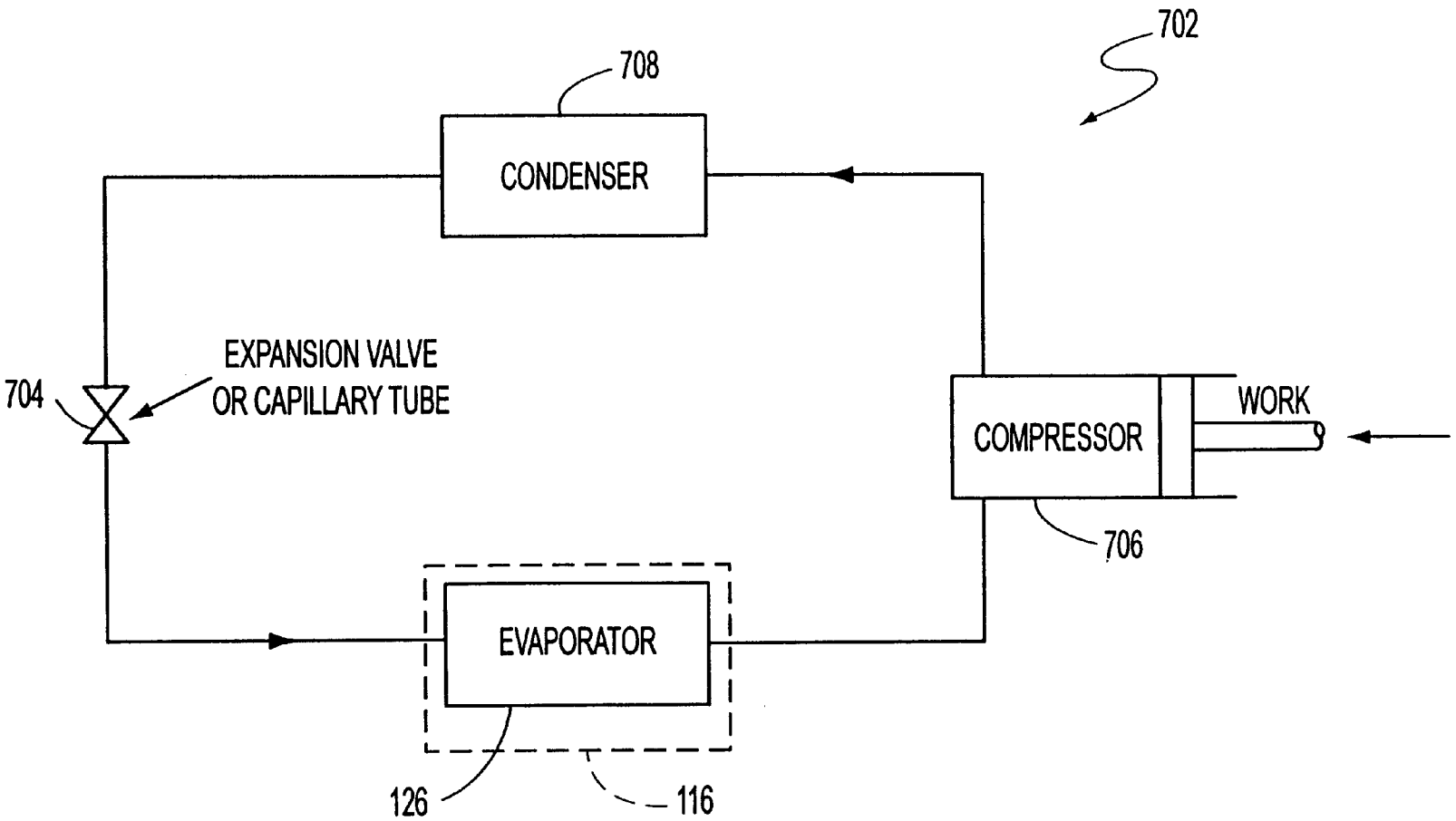
FIG. 7 is a schematic view showing the condenser element configured as part of a closed circuit vapor compression circuit.

FIG. 7 shows a schematic view of a condenser element 126 configured as the evaporator element in a well known closed circuit vapor compression circuit 702, which is similar to the circuit in a conventional dehumidifier. The working fluid may be Freon or an environmentally-friendly Freon alternative. The condenser element 126 uses the expanded working fluid channeled from an expansion device 704 to condense ambient air, and the resulting warmer working fluid is channeled to a compressor 706 (powered by electricity or other work input). The compressor 706 compresses the working fluid and channels it to a condenser 708. The condenser 708 condenses the compressed working fluid based on an air-side heat exchange, and channels the condensed working fluid back to the expansion device 704 to complete the circuit 702.

Figure 4:
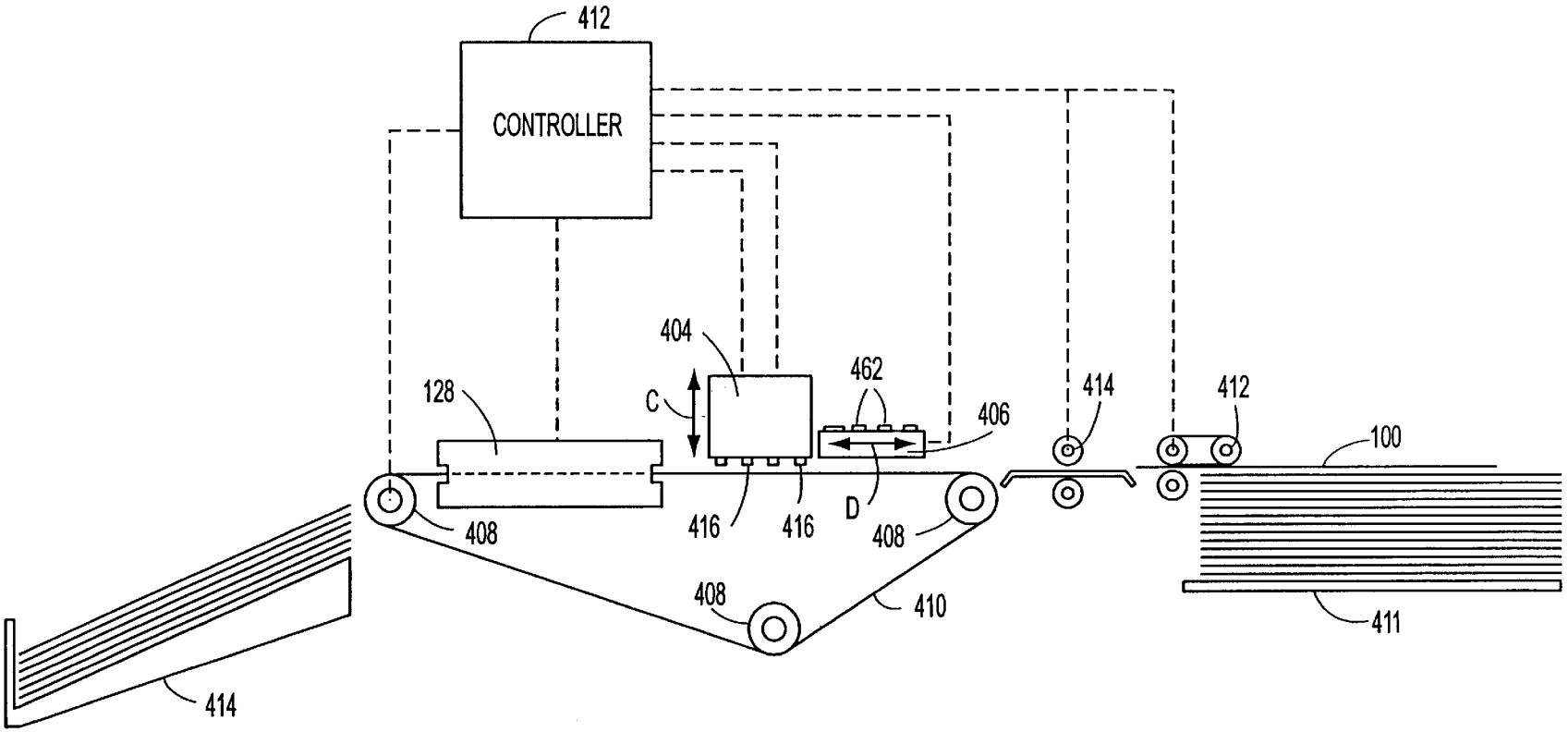
FIG. 4 is a schematic side view of a full-width array printhead marking device with a dryer and a maintenance station.
Figure 5:
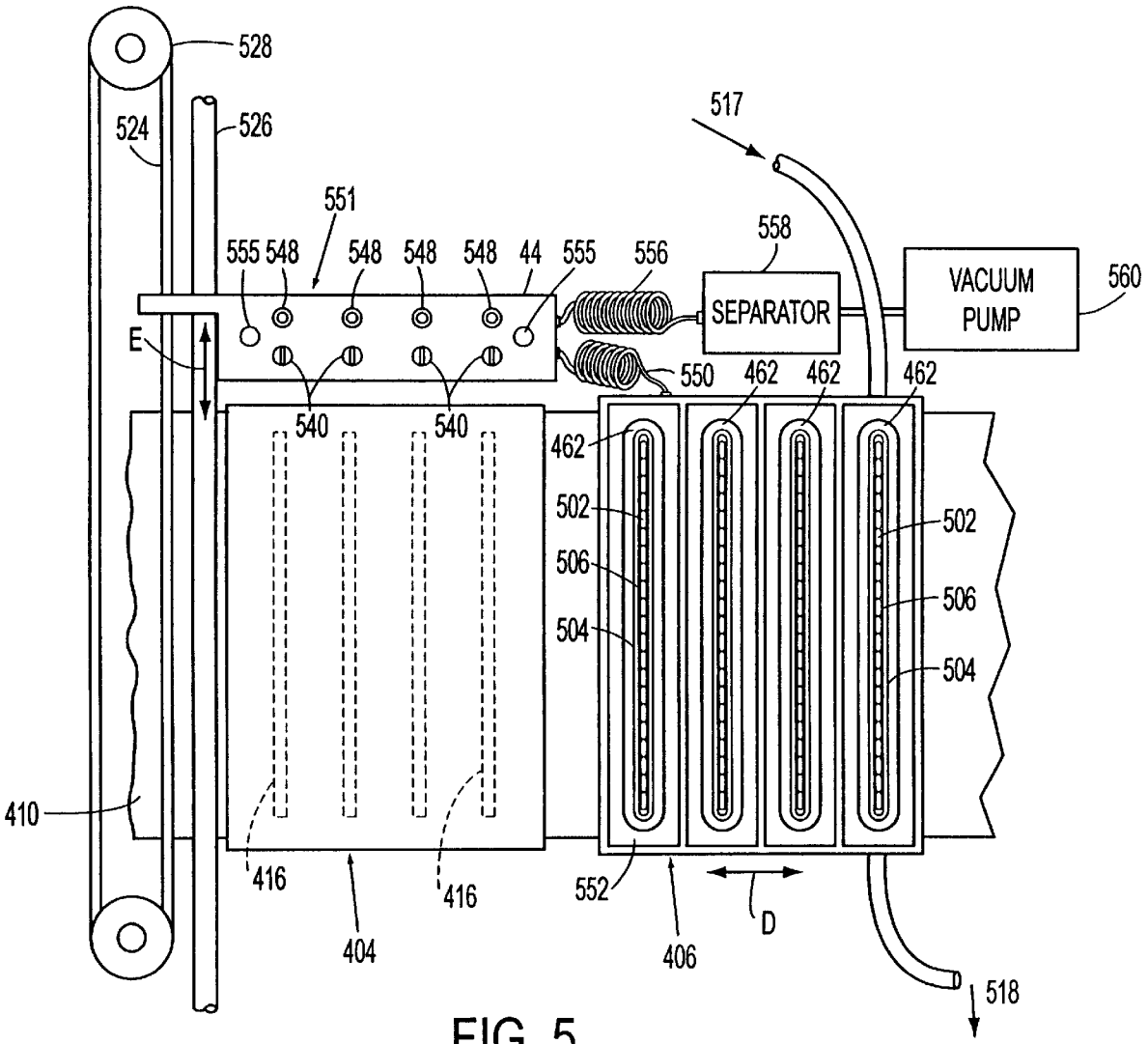
FIG. 5 is a partial plan view of the full-width array printhead marking device and maintenance station of FIG. 4.

FIGS. 4 and 5 show an embodiment of the invention for a full-width array printhead marking device. FIG. 4 shows a schematic diagram of a full-width array printhead ink marking device. At the right side, a top sheet of a stack of the medium 100 is being fed from the paper input tray 411 through the paper input feed assembly 412 to an intermediate station 414. The medium 100 is placed on a belt 410, which circulates through the system on a series of rolls 408. As the medium 100 advances on the belt, it passes beneath a cap 406 and a printhead assembly 404. In this embodiment, the printhead assembly 404 includes four individual printheads 416. The medium 100 is marked by the printhead assembly 404 and then travels through the dryer 128, which at least partially dries the freshly marked medium 100. Completed sheets of the medium 100 are ejected and stored in the paper output tray 414. The entire process is controlled and coordinated by a controller 412, which is connected to the paper input feed assembly 412, the intermediate station 414, the cap 406, the printhead assembly 404, the dryer 128 and at least one of the rolls 408.

The cap 406 is disposed to move in a direction D to engage the nozzle face of the printhead assembly 404, as controlled by the controller 412, when the printhead assembly 404 is not used for extended periods.

FIG. 5 is a partial plan view of the printhead assembly 404 and the cap 406. During maintenance, the printhead assembly 404 moves upward in the direction C (FIG. 4), and a carriage 551 travels in a direction E along a rail 526, which is driven by a timing belt 524 and a motor pulley 528. Attached to the carriage 551 are optional vacuum nozzles 540 and wet wiper nozzles 548. As the carriage travels beneath and across the width of the printhead assembly 404, debris and excess ink is vacuumed by the vacuum nozzles 540 (if provided), and the printhead surface is wiped by the wet wiper nozzles 548. The function and operation of the wet wiper nozzles 548 is similar to the wiper nozzles 110 described above in conjunction with the partial-width array printhead embodiment.

When the carriage 551 reaches the end of the printhead assembly 404, it reverses direction and returns to the position shown in FIG. 5. Thereafter, the cap 406 moves leftward along the direction D beneath the printhead assembly 404. Seals 462 of the cap 406 sealingly engage each of the individual printheads 416 of the printhead assembly 404, thereby preventing undesirable drying of ink in the printhead nozzles.

The wet wiper nozzles 548 are connected to a maintenance fluid reservoir in a housing 552 of the cap 406. If vacuum nozzles are provided, a vacuum pump 560 and a separator 558 are connected to the vacuum nozzles 540 via a vacuum line 556.

The vacuum nozzles 540 and the wet wiper nozzles 548 are maintained at an appropriate distance from the nozzle surface of the printhead assembly 404 by followers 555, which glide across the surface of the printhead assembly 404.

In this embodiment, condensate obtained from the condensation process with a condenser element 126 replenishes the maintenance fluid through a drain tube 517. Once the desired level is reached, excess fluid overflows out of the reservoir through an overflow 518.

Figure 6:
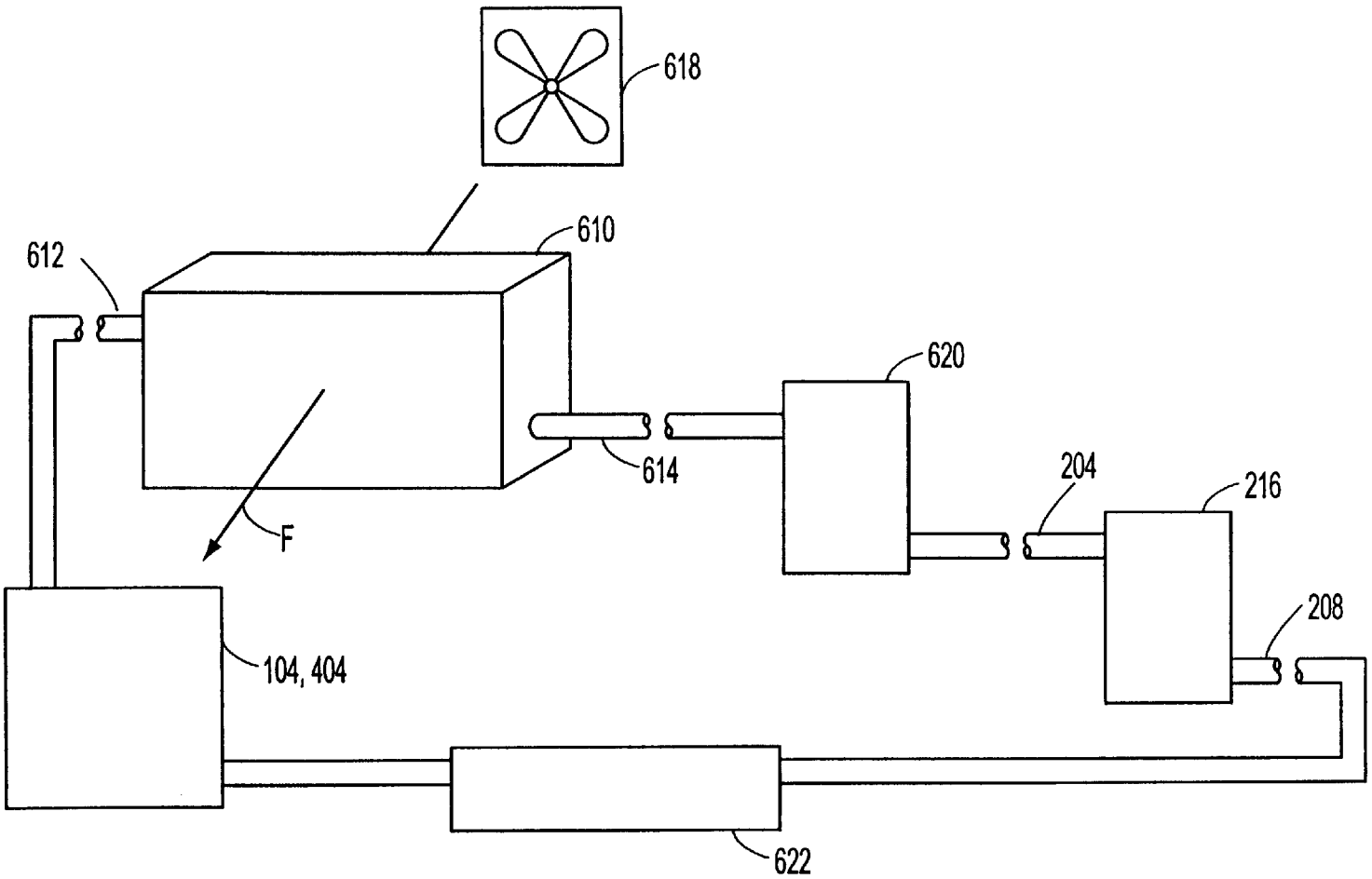
FIG. 6 is a schematic flow circuit diagram of the condenser element configured in a printhead and heat exchanger cooling circuit.

FIG. 6 shows a flow circuit for an embodiment of the invention in which the cooling tube 216 is connected to the printhead 104, 404 and a heat exchanger 610 for the printhead. In particular, a heat exchanger outlet 614 of the heat exchanger 610 is connected to the cooling fluid inlet 204 of the cooling coil 216, and the cooling fluid outlet 208 is connected to the printhead 104, 404. The printhead 104 404, is connected to the heat exchanger 610 by a heat exchanger inlet 612. As a result, the heat exchanger 610 cools cooling fluid circulated through the printhead 104, 404 and supplies the cooled fluid to the cooling coil 216. The warmer cooling fluid that exits from the cooling coil 216 is supplied to the printhead 104, 404, but can still cool the printhead effectively. Preferably, the cooling circuit includes a pump 620 positioned between the heat exchanger 610 and the cooling coil 216. The pump 620 assists in circulating the cooling fluid throughout the cooling circuit.

Preferably, the cooling circuit also includes an accumulator 622, which is a reservoir dimensioned to hold an appropriate amount of cooling fluid to account for changes in volume of cooling fluid during state changes.

As shown, the heat exchanger 610 is of the air-to-fluid cross flow type, but other heat exchangers may also be used. As also shown, a fan 618 may be used to force air flow in a direction F through the heat exchanger across the flow of the cooling fluid through the heat exchanger 610.

Although this invention is described in conjunction with specific embodiments thereof, many alternatives, modifications and variations will be apparent to those skilled in the art. Accordingly, the preferred embodiments of the invention as set forth above are intended to be illustrative, not limiting. Various changes to the invention may be made without departing from its true spirit and scope as defined in the following claims.

What is claimed is:

1. The method of replenishing fluid used in an ink marking device maintenance station of an ink marking device that marks media with ink and includes a dryer, comprising:

obtaining condensate from ambient air through a condensation process;

drying the media marked with said ink with the dryer, thereby producing a dryer effluent;

drying the dryer effluent in the condensation process;

channeling the dried dryer effluent back to the dryer for use in the drying of the media; and channeling the condensate to a reservoir in communication with the ink marking device maintenance station.

2. The method of claim 1, wherein obtaining the condensate includes condensing the dryer effluent from the dryer.

3. The method of claim 1, wherein the marking device includes a condensing element and a condensing element temperature is lower than an ambient air temperature of the ambient air, and wherein obtaining the condensate includes performing a heat transfer process from the ambient air to the condensing element.

4. The method of claim 3, wherein the condensing element is a peltier device connected to a power source, the peltier device having a hot side and a cold side, and wherein the condensation process includes passing the ambient air over the cold side of the peltier device such that heat is transferred from the ambient air to the peltier device.

5. The method of claim 3, wherein the condensing element is a cooling coil through which fluid flows, and wherein the condensation process includes passing the ambient air over the cooling coil such that heat is transferred from the ambient air to the cooling coil and the fluid.

6. The method of claim 5, wherein the cooling coil has a cooling coil inlet and a cooling coil outlet, and the ink marking device has a printhead and a heat exchanger that cools the printhead, and wherein the condensation process includes circulating the fluid from the heat exchanger through the cooling coil inlet and out the cooling coil outlet before returning the fluid to the printhead.

7. A fluid replenishment system for an ink marking device maintenance station in an ink marking device that marks media with ink, the ink marking device maintenance station using fluid to maintain a printhead of the ink marking device, the system comprising:

a condensing element that condenses ambient air to obtain condensate;

a dryer that dries the media marked with the ink, the dryer producing a dryer effluent which is included in the ambient air;

a reservoir that receives the condensate channeled from the condensing element, wherein the reservoir is in communication with the ink marking device maintenance station;

a dryer return duct that conveys dryer effluent that was dried from removing condensate back to the dryer for use in drying the marked media.

8. The fluid replenishment system of claim 7, further comprising a vapor compression circuit having a condenser, an expansion device, an evaporator and a compressor, and wherein the condensing element is the evaporator.

9. The fluid replenishment system of claim 7, wherein the condensing element is positioned to receive the dryer effluent such that the condensing element condenses the dryer effluent.

10. The fluid replenishment system of claim 7, wherein the condensing element is a cooling coil.

11. The fluid replenishment system of claim 7, wherein the reservoir is connected to the maintenance station by a connecting line.

12. The fluid replenishment system of claim 7, wherein the reservoir is part of the maintenance station.

13. The fluid replenishment system of claim 7, wherein the reservoir includes a fluid level regulator that regulates a fluid level in the reservoir.

14. The fluid replenishment system of claim 13, wherein the fluid level regulator is an overflow tube positioned immediately above a desired fluid level with a float valve, and wherein if the fluid level in the reservoir reaches the desired fluid level, additional fluid flows out of the overflow tube.

15. The fluid replenishment system of claim 7, wherein the condensing element is a peltier device.

16. The fluid replenishment system of claim 10, wherein the ink marking device includes a printhead and a heat exchanger that cools the printhead, wherein the cooling coil, the printhead and the heat exchanger are connected such that cooling fluid is circulated from the heat exchanger to the cooling coil, from the cooling coil to the printhead, and from the printhead to the heat exchanger.

17. The fluid replenishment system of claim 16, further comprising a pump that circulates the cooling fluid, the pump being positioned between the heat exchanger and the cooling coil.

18. The fluid replenishment system of claim 17, further comprising an accumulator positioned between and connected to the cooling coil and the printhead, the accumulator receiving and storing excess cooling fluid.

* * * * *